United States Patent [19]

Lister

[11] 4,289,496

[45] Sep. 15, 1981

[54] FINISHING PROCESS

[75] Inventor: Gordon H. Lister, Leeds, England

[73] Assignee: Sandoz Ltd., Basel, Switzerland

[21] Appl. No.: 146,442

[22] Filed: May 5, 1980

Related U.S. Application Data

[60] Division of Ser. No. 510,470, Sep. 30, 1974, which is a continuation-in-part of Ser. No. 182,852, Sep. 22, 1971, abandoned.

[30] Foreign Application Priority Data

Sep. 22, 1970 [GB] United Kingdom ..... 45144/70

[51] Int. Cl.[3] ..... B08B 7/00

[52] U.S. Cl. ..... 8/477; 8/149.1; 8/149.3; 8/159; 8/594

[58] Field of Search ..... 8/477, 594, 149.1, 159, 8/149.3

[56] References Cited

U.S. PATENT DOCUMENTS 1,948,568 2/1934 Faber et al. ..... 8/477
3,762,866 10/1973 Rayment et al. ..... 8/149.1

FOREIGN PATENT DOCUMENTS 7214780 5/1973 Netherlands .
1134221 11/1968 United Kingdom .

*Primary Examiner*—A. Lionel Clingman
*Attorney, Agent, or Firm*—Gerald D. Sharkin; Richard E. Vila; Thomas C. Doyle

[57] ABSTRACT

A finishing process for porous fibrous materials, especially for textiles, especially a dyeing process, in the presence of relatively small amounts of water and a foaming agent, is carried out at a liquor to material ratio of about 0.25:1 to 5:1. This water-saving finishing process leads to equal and level finishings especially important in the dyeing area.

13 Claims, No Drawings

FINISHING PROCESS

This is a division of application Ser. No. 510,470 filed Sept. 30, 1974, which in turn is a continuation-in-part of Ser. No. 182,852, filed Sept. 22, 1971, now abandoned.

In typical padding processes for dyeing textiles, the textile material in open width form is impregnated evenly by means of a padding mangle, in which the textile is passed through one or more nips (usually at most two nips). The textile may be saturated before passing through the nip, as in "slop padding"; or the impregnating liquid may be carried as a film on the surface of one of the rolls comprising the nip and transferred to the textile as it passes through the nip, as in "nip padding". The textile material impregnated in this way is then usually passed straight into a steamer or given a "Thermosol" treatment in order to fix the dye on the fibre. The padding liquors used in such processes may advantageously contain small amounts of additives possessing a foaming action but foam formation in these conventional padding processes (if it occurs) does not take place until the fixation stage. The formation of a foam at the nip of the padding mangle is considered undesirable, particularly when a light shade is desired, because, if a bubble forms and bursts, the area of the textile material where the bubble was will be dyed a lighter shade than the surrounding area. For this reason it is often recommended to add a foam suppressant to a padding liquor. In order to obtain level dyeings it is essential that the material be in open width form and that the tension of the textile material be closely controlled.

Similarly, in the so called "Slop Dye" process for the continuous dyeing of carpets, (which is described in American Dyestuff Reporter, Vol. 57, No. 27 pages 41 to 47), the carpet is impregnated with unthickened liquor simply by passage over a roll in a trough. It is then led upward over a guide roll into the steamer. During the vertical phase of this journey, the excess liquor flows back into the trough. At constant operating speed, a uniform amount of liquor is absorbed by the carpet, ranging from 400 to 600%, depending on the carpet construction. In the steamer the saturated steam used in heating the carpet condenses and it is said that what takes place in the steamer is an exhaustion dyeing process at 100° C., at a liquor to material ratio of about 5:1 to 7:1. It is known to add to liquors used for this "slop dyeing" process with a view to reducing the so-called "frosting" effect compounds having, inter alia, a foaming action so that it is possible that foaming may take place during fixation. It is an essential feature of the "slop dye" process that the carpet be in open width form.

In these dyeing methods great care must be taken to ensure that the dyeing liquor is distributed evenly in the substrate before fixation commences since otherwise, especially in the case of dyeings of light shade, unlevel dyeings are obtained.

It has been suggested (Ratgeber für das Färben von Baumwolle und anderen Fasern Pflanzlichen Ursprungs - V. Auflage - 1925) to dye cellulosic fibres with direct or sulphur dyes in a foam bath. According to this process the cellulosic fibres, usually in the form of yarn on a cross bobbin, are treated with a dyeing foam which is produced outside the substrate by heating the dyebath. The cellulosic material is packed in a wooden lattice case which is lowered into the dyeing foam. This process has the disadvantage that the substrate is not in direct contact with the whole dyeing liquor but only with the part of it that is foaming with the result that dyeing is very slow. It is stated that claims in respect of levelling and fastness should not be made for material dyed in foam.

In conventional dyeing processes which generally use liquor to goods ratios of from 5:1 to 40:1 the formation of foam on an aqueous dye bath is regarded in the trade as a highly undesirable characteristic of a dyeing solution or suspension if only because the generation of a foam inside a pump leads to a considerable loss of efficiency in pumping. For this reason anti-foaming agents, for example silicone preparations, are very widely used as additives to dye baths to prevent the formation of a foam.

It has now been found that fibrous and other porous substrates can be treated with dyes and also finishing agents other than dyes to give level finishes by contacting the substrate with a small quantity of a finishing liquor capable of foaming and by submitting the textile material to repeated mechanical action; in this way all the liquor contacts all the substrate in a short time and penetrates uniformly into the material to be treated whilst a minimal quantity of water is employed. The material can then be submitted to finishing conditions.

The present invention relates to a finishing process for a porous textile material, which comprises contacting said textile material with a finishing agent, in the presence of water and of a foaming agent at a liquor to material ratio of from 0.25:1 to 5:1 by weight, subjecting said textile material to a dynamic treatment to distribute said finishing agent substantially uniformly through said textile material, and submitting said textile material to finishing conditions to cause said finishing agent to perform its finishing action upon said textile material.

Preferably the liquor to material ratio is from 0.5:1 to 3:1, and even more preferably from 1:1 to 1.5:1 by weight.

The finishing process of the present invention can be carried out on all kinds of porous, especially fibrous, textile materials which are known to be dyeable by means of padding or exhaustion dyeing processes, e.g. loose fibres, filaments, sliver, threads, knitted, woven or tufted goods, non wovens, velvets, carpets and felts of synthetic, half-synthetic or natural (vegetable or animal) materials, as well as porous plastics and leather. As examples of suitable porous textile materials the following substrates can be mentioned: animal skins, such as leather or sheepskin; synthetic leathers such as "Xylee" (Registered Trade Mark); natural polyamide fibres, such as wool, mohair or silk; synthetic polyamide fibres such as nylon 6, nylon 66, nylon 6/66, nylon 610, nylon 11 (e.g. "Rilsan" Registered Trade Mark) or "Qiana"; polyurethane fibres; natural cellulose fibres, such as cotton or linen; other natural fibers, such as animal furs and camel hair; regenerated cellulose fibres, such as viscose filament, spun rayon or cuprammonium rayon; secondary cellulose acetate and cellulose triacetate fibres; polyolefine fibres, such as polypropylene fibres or their basic or acid modifications; acrylonitrile polymer and copolymer fibres such as those containing at least 80% of acrylonitrile; fibres of polyvinyl compounds, such as copolymers of vinylidene chloride; fibres of linear aromatic polyesters, such as the polycondensation products of terephthalic acid and glycols, in particular ethylene glycol and 1,4-di-(hydroxymethyl)-cyclohexane; and blends of the afore-mentioned fibres, for example polyester/polyamide, cotton/polyamide, wool/synthetic polyamide and polyacrylonitrile/polyamide blends.

As finishing agent any finishing agent that can be applied to the substrate by padding or from a treatment bath is suitable, e.g. dyes, fluorescent dyes, optical brighteners, softening agents, anti-soiling agents, mothproofing agents, starches, anti-fungus agents, waterproofing agents, fireproofing agents, scouring agents, and anti-static agents as well as agents for improving the fastness of dyings and the non-felting of wool. Further there can be applied agents for the shrink-proofing, desizing, crease-resistant finishing, bleaching and "S" finishing of the substrate and in particular of textiles. The finishing agent may be water soluble or water insoluble in which latter case it is used in finely divided form and substantially uniformly dispersed through the liquor.

The textile finishing agent will be chosen to be appropriate for the textile material to be treated. For example, where natural or synthetic polyamide and basically modified fibres are to be dyed, a water soluble anionic dyestuff e.g. a so-called wool dye, is preferably used; such dyes belong e.g. to the monoazo, disazo, anthraquinone, metal phthalocyanine e.g. copper or nickel phthalocyanine, triarylmethane, xanthene, nitro, dioxazine, 1:1 chromium, 1:2 cobalt or 1:2 chromium complex series, the metallizable e.g. chromatable dyes, the direct dyes which in a neutral to acid bath have affinity for wool and/or nylon, or the fibre reactive dyes, such as dyes containing a 2,4-dichloropyrimid-6-yl, 2,4-dichloro-1,3,5-triazin-6-yl or acryloyl group.

For dyeing cotton and other cellulose fibres azoic, basic, direct, mordant, fibre reactive, sulphur and vat dyes may be used.

For dyeing hydrophobic fibres e.g. polyolefine fibres, polyvinyl fibres and linear aromatic polyester fibres, disperse dyes are preferably used, for example disperse dyes of the monoazo, disazo, anthraquinone, nitro, styryl or quinophthalone series.

Basic dyes are preferably used for dyeing acrylonitrile polymers and copolymers, for example basic dyes of the nitro, styryl, methine, polymethine, anthraquinone, quinophthalone, azomethine or azo series.

When blends of two or more types of fibres are dyed by our process a single liquor may be used containing a dye for each fibre or several liquors in turn, each containing a dye for one of the fibres. For example, for dyeing a polyester/cotton blend a single liquor containing both a disperse dye and a reactive dye may be used, or the blend may be dyed with two liquors in turn each containing a dye appropriate for one of the fibres.

As optical brightening agent there may be used, for example any of the conventionally used colourless stilbene dyes.

The foaming agent is an anionic, cationic, amphoteric or non-ionic agent and must be compatible with the finishing agent and with any other finishing assistant that may be used, i.e. it must not react to any appreciable extent during the finishing process with the chosen finishing agent or any assistant present. In general with ionic finishing agents there will be used preferably foaming agents of similar or neutral ionic character, i.e. with anionic finishing agents there will be used anionic, amphoteric or non-ionic foaming agents, of which especially the anionic foaming agents are preferred; with cationic finishing agents there will be used cationic, or non-ionic foaming agents, of which the nonionic agents are preferred; with non-ionic finishing agents, which may require the additional use of a suitable carrier (e.g. benzyl alcohol or 2-phenylethanol) either ionic or non-ionic but preferably anionic foaming agents may be employed. The type of foaming agent to be used will usually be determined by the pH conditions to be used, and its compatibility with the dyestuff or other textile finishing agent to be used and with the other additives to the treatment liquor. Suitable anionic foaming agents include aliphatic and/or aromatic carboxylic and sulphonic acids, their esters or amides and aliphatic or araliphatic sulphates and phosphates. Examples of suitable anionic foaming agents are partially carboxymethylated alkyl-, aryl-, alkylaryl- or arylalkylpolyglycolethers, alkane-, alkylbenzene- and alkylnaphthalene sulphonates, the primary or secondary alkylsulphates, the alkylpolyglycol-, alkyl- phenylpolyglycol- and dialkylphenylpolyglycol-ether sulphates, the sulphonated or sulphated oils, the fatty acid taurides, and the fatty acid-sulphato-ethylamides. Suitable non-ionic agents are the water-soluble adducts obtained by reacting 8 to 50 moles of ethylene oxide with a fatty alcohol, a fatty acid, a fatty acid amide, an alkylmercaptan or an alkylphenol (e.g. nonyl-, decyl - or undecylphenol). Examples of suitable cationic agents are the adducts obtained by reacting 8 to 100 moles of ethylene oxide with a fatty alkylamine or a fatty alkylpoly-amide and their quaternized derivatives. As amphoteric agents the following may be mentioned: the fatty acid-sulphato-ethylaminoethyl-amides, fatty acid $\gamma$-sulpho-$\beta$-hydroxy-propylaminoethylamides, the mono- or disulphated adducts of 8 to 100 moles of ethylene oxide and a fatty alkylamine or a fatty alkylpolyamine.

Besides the finishing agent (or agents), the foaming agent (or agents) and the water necessary for foam formation other finishing assistants are added to the treatment liquor if necessary: such finishing assistants are e.g. carriers, levelling agents (e.g. retarding agents), emulsifiers, thickeners, salts, acids, or wetting agents. For example it may contain levelling agents such as alkyl-, alkenyl- or alkylphenyl-polyglycol ethers in which the hydrophobic residue contains preferably from 8 to 18 carbon atoms (in the case of alkylphenyl 14 to 18 carbon atoms) or also mixtures of carboxymethylated polyglycol ethers with a hydrophobic residue of from 8 to 24 carbon atoms and high molecular weight eventually quaternated polyamines (see U.K. Specification No. 808,647). Many of the other commonly used textile chemicals may also be added, for example Glauber's salt and metal sequestering agents.

Neutral salts such as sodium chloride may be used. Acids may be added, for example hydrochloric acid, sulphuric acid or an organic acid, such as formic, acetic or propionic acid. Acid salts such as sodium hydrogen sulphate may also be added if desired. A buffering agent such as sodium or ammonium monohydrogen or dihydrogen phosphate may be used if appropriate. When vat dyes are used a reducing agent such as sodium hydrosulphite may be added to the liquor.

Under certain circumstances it may be desirable to add a thickening agent such as an alginate to the textile treating liquor but this will not usually be necessary.

It will be appreciated that when our process is carried out using a finishing agent such as a dye or optical brightener that is substantive for the fibre it is necessary to carry the process out in two stages. In the first or "distribution" stage the finishing agent must be distributed substantially uniformly through the textile material under conditions such that the finishing agent is rendered substantially non-substantive to the fibre. This can then be followed by a second or "finishing" stage in which the textile material is submitted to finishing conditions to allow the finishing agent to perform its finishing action on the material. Thus we prefer to carry out the distribution stage at temperatures from 0° to 30° C. and preferably at or near ambient temperature, e.g. from 15° C. to 25° C. If a finishing agent with a high affinity for the substrate is employed it is of advantage to cool the liquor and/or to add substances having a retarding action in order to reduce the affinity of the finishing agent for the fibre during the distribution stage so that even distribution of the finishing agent can take place in the substrate. Thus a retarder can be added to the liquor and/or the pH value of the liquor can be regulated to reduce the substantivity of a finishing agent. For example during the distribution of a dyeing liquor containing a fibre reactive dye the pH will preferably be lowered during the distribution stage and then raised again after distribution has taken place so that fixation can occur. Similarly during the distribution of a liquor containing an anionic dye it may be necessary to raise the pH and then to lower it before fixation.

Although it is possible to contact the textile material with an aqueous solution of the foaming agent in a first step and to "wet out" the material uniformly with this aqueous solution by giving the material a dynamic treatment and thereafter to add the finishing agent (optionally dispersed in some further liquor) and to disperse the finishing agent substantially uniformly through the textile material by giving the textile material a further dynamic treatment, it is usually more convenient to prepare a treatment liquor containing the finishing agent and the foaming agent and to contact the textile material with this treatment liquor.

The dynamic treatment comprises the subjection of the textile material to a dynamic action for a period sufficient to achieve the desired distribution of the finishing agent. The dynamic action is a multiply repeated mechanical action (often repeated several hundred times at least) obtained by any force that causes the parts (e.g. the fibres) of the substrate to be in relative mutual movement. Thus the dynamic action can be effected by for example, continuous rubbing, continuous brushing repeated passage of the textile material through a mangle, gravitational forces (as for example tumbling in a rotating drum) or sonic or ultrasonic waves.

Typically the process may be carried out by contacting the textile material with the liquor at room temperature followed by or contemporaneously with a short mechanical treatment of, for example, 5–30 minutes at room temperature to develop a foam and to disperse it uniformly throughout the textile material. Suitable additions may then be made, if desired, to increase the substantivity of the finishing agent for the textile material (for example an addition of an acid or a base to change the pH of the liquor) and the mechanical treatment continued to ensure uniformity of the liquor throughout the material. The liquor-impregnated material may then be heated to the desired temperature, for example to 95°–100° C. at normal atmospheric pressures or up to 140° C. under superatmospheric pressure whilst continuing the mechanical treatment in order to maintain the foam.

Alternatively, once uniform distribution of the liquor through the textile material has been achieved (and the pH has, if necessary, been adjusted), the impregnated material may be submitted to a "Thermosol" fixation treatment or to a steam treatment to fix the finishing agent on the material.

The material may then be treated with any desired after treatment process. However, in many cases, it may be sufficient simply to hydro-extract the material and dry it. If desired a silicone anti-foaming agent may be added before hydroextraction. Typical after-treatments include back-tanning in order to increase the fastness of acid dyes on synthetic polyamides and impregnation of cellulosic materials with a cationic resin to increase the fastness of direct dyes.

At liquor to goods ratios of 1:1 to 1.5:1 the volume of liquor is usually insufficient to wet completely the textile material to be treated and it was extremely surprising, in our opinion, to find that it is possible, even after only a short mechanical treatment at room temperature, to disperse the liquor substantially uniformly throughout the textile material. Often a foam is not immediately apparent to the naked eye but, if the wet material is rubbed with the finger, formation of a foam is apparent on the textile surface.

The textile material can be contacted with the finishing liquor in any desired way. For example the liquor can be poured or sprayed on the material. If desired, the goods to be treated can be padded with the treatment liquor; although the initial result of such a padding step is usually an extremely uneven distribution of liquor through the textile material yet a subsequent short mechanical manipulation generally results in substantially uniform dispersion of the liquor throughout the material.

The time taken to achieve substantially uniform distribution of the finishing agent through the textile material depends, inter alia, on the intensity of the dynamic action, the concentration of the foaming agent, the liquor to material ratio and the nature of substrate. Thus, if an unacceptably long time is needed in order to obtain the desired even distribution of the finishing agent through the textile material, this period can usually be reduced by increasing the concentration of the foaming agent, by increasing the intensity of the dynamic action, or by increasing the liquor to material ratio, or by a combination of any of these.

In a particularly preferred process the dynamic treatment is effected by tumbling the textile material in a rotating drum the internal cylindrical surface of which is provided with ledges or pegs to lift the material. The intensity of this dynamic treatment can be increased, for example, by placing the material in a bag with some metal balls before tumbling commences. From a practical point of view we consider that it is desirable to effect the dynamic treatment in a period of from 5 to 30 minutes. Provided that the dynamic action is sufficiently intense we have found that we get the desired distribution of the finishing agent in the "distribution" stage within a reasonable period of time if we use a liquor containing a foaming agent at a concentration such that the liquor gives a head of foam of at least 10 cm, and preferably at least 15 cm, in the test described by Ross & Miles in "Oil and Soap", May 1941, at page 99. In general this test should be carried out with the proposed treatment liquor, that is to say a liquor already containing besides the foaming agent and the finishing agent also any other assistants. The foaming ability of aqueous solutions of various commercial foaming agents by the method of Ross & Miles is shown in the following Table I.

TABLE I

| Commercial Foaming Agent | Height of foam formed (in cms) at different concentrations | | | | | | |
|---|---|---|---|---|---|---|---|
| | 1 g/l | 2 g/l | 5 g/l | 10 g/l | 20 g/l | 30 g/l | 40 g/l |
| 1 | 15 | 18 | 20 | 21 | 22 | 23 | 24 |
| 2 | 5 | 6 | 10 | 15 | 18 | 20 | 22 |
| 3 | 4 | 5 | 6 | 12 | 15 | 16 | 17 |
| 4 | 4 | 5 | 9 | 12 | 14 | 15 | 15 |
| 5 | 15 | 20 | 21 | 22 | 23 | 23 | 23 |
| 6 | 8 | 9 | 13 | 14 | 18 | 19 | 19 |
| 7 | 3 | 4 | 6 | 7 | 11 | 11 | 11 |
| 8 | 3 | 4 | 5 | 6 | 6 | 7 | 7 |
| 9 | | 10 | | | | 19 | |

In Table I the commercial foaming agents 1 to 9 have the following constitutions:
1 = 60% paste of lauryl—$(OC_2H_4)_2$—O—$SO_3Na$
2 = 35% solution of octylphenyl-decaglycolether
3 = 30% solution of stearylpentacosa-glycolether
4 = 45% solution of the adduct of 90 moles of ethylene oxide and 1 mole of 3-stearylaminopropylamine.
5 = 70% solution of partially carboxymethylated alkylpolyglycolether e.g. $C_{12}H_{25}$—$(OC_2H_4)_6$—O—$CH_2$—COONa + $C_{12}H_{25}$—$(OC_2H_4)_6$—OH
6 = 30% solution of highly sulfonated castor oil
7 = The adduct of 30 moles of ethylene oxide to 1 mole of castor oil
8 = The condensation product of 4 moles benzyl chloride with 1 mole of ethylene diamine quaternized with 2 moles of dimethylsulphate (20% in a mixture of equal parts of water, iso-propanol and the adduct of 30% moles of ethylene oxide to 1 mole of castor oil).
9 = Nonylphenylpentadecaglycol ether.

Another test for the suitability of a foaming agent for the process of the present invention is the following:

Three identical samples of fabric are prepared: One sample is then padded to 100% pick-up with a dyeing liquor containing the foaming agent and any other additions. The padded sample is then placed between the other two samples and the "sandwich" so formed is repassed once through the pad. If the three samples are now virtually indistinguishable to the eye, then the foaming agent at that concentration is considered suitable for use in our process provided that it also give a head of foam of at least 10 cm (and preferably at least 15 cm) in the Ross & Miles test.

The amount of foaming agent to be added to the treatment liquor may vary in practice within fairly wide limits. Generally speaking it will usually be necessary to use at least 0.1 g per liter of the foaming agent in the treatment liquor. More often satisfactory results are obtained using concentrations of between about 5 and about 35 grams per liter for example between about 15 or 20 and 30 grams per liter.

Although many compounds possess the ability to form a foam under the conditions described by Ross and Miles, many such compounds also possess properties which may or may not be useful in the finishing liquor; for example besides having a foaming action a particular foaming agent may also have a retarding action on the finishing agent. Accordingly we prefer to use foaming agents which are inert or substantially inert in the finishing liquor, that is to say they do not demonstrate any appreciable subsidiary effect on the finishing agent, for example a retarding effect. Thus, for example, a highly sulphonated castor oil is sold as a levelling and/or "blocking" agent but, although in sufficient concentration, it can give a sufficiently high head of foam in the test described by Ross and Miles yet, because it possesses levelling and/or "blocking" properties, we prefer not to use it as the sole foaming agent. That the important factor is the foaming power of the foaming agent, rather than its wetting ability caused by reduction of the surface tension, can be demonstrated in the following way. Three identical samples of nylon fabric were taken and impregnated at a liquor to goods ratio of 3:1 with different solutions. One was impregnated with an aqueous solution of an acid dye, another with an aqueous solution of the same acid dye at the same concentration but containing sufficient n-propyl alcohol to reduce the surface tension to 30 dynes/cm and the third with an aqueous solution of the acid dye at the same concentration containing 12 g/liter of the foaming agent lauryl—$(OC_2H_4)_2$—$OSO_3Na$. The samples were then each tumbled separately in a drum for 15 minutes at room temperature with an identical, dry undyed sample of the nylon fabric. In all cases the initially undyed samples absorbed colour from the respective dyed samples. However, in the first case the initially undyed sample (where there was water only in the dye liquor) was extremely patchy in colour and the second (with n-propyl) alcohol in the liquor) was also very patchy. The third initially undyed sample (in the case where there was lauryl—$(OC_2H_4)_2$—$OSO_3$ Na in the dye liquor) was indistinguishable to the eye from its corresponding initially impregnated sample showing that distribution of the liquor through both samples of the material was essentially uniform.

It is possible in many cases to carry out all the required finishing processes on a textile material in sequence, each of the finishing processes being carried out at a liquor to goods ratio of from about 0.25:1 to about 5:1, preferably from 1:1 to 2:1, by weight in the presence of a foaming agent. Thus, for example, nylon garments can be successively scoured, bleached, washed, dyed and backtanned by our process, the garments being hydro-extracted and, if desired, rinsed between each of the finishing steps. It is a simple matter to determine in any particular case how much liquid the material retains after a given period of hydro-extraction and to calculate how much additional water must be used in the succeeding step to restore the liquor to goods ratio to the desired value after such a period of hydro-extraction. Although in many cases in such a sequential operation it is preferred to make an addition of foaming agent in the liquor containing the finishing agent of each treatment step, it may not in every case be necessary to do so, provided that the goods being treated are always kept damp during and between treatment steps. Thus in many cases an addition of a sufficient quantity of the foaming agent to the liquor containing the treatment agent of the first treatment step may permit one or more succeeding treatment steps to be carried out without the need for the addition of further foaming agent, the goods being hydro-extracted (and rinsed if desired) but kept damp between treatment steps. In dyeing polyester fibres by the process of our invention and in some cases in dyeing cellulose triacetate fibres, it is desirable to make an addition of a carrier, e.g. phenol, benzoic acid, salicyclic acid, benzyl alcohol or 2-phenylethanol. Preferably the amount of benzyl alcohol added is sufficient to give a concentration of at least 40 grams per liter, and more preferably at least 50 grams per liter, during the distribution stage, that is to say whilst the polyester fibres are being mechanically treated at or near room temperature in order to disperse the liquor uniformly through the material prior to heat treatment. It is desirable that the benzyl alcohol form a solution (and not an emulsion) at least during the distribution stage. In the dyeing of polyesters we have found that the foaming agent lauryl—$(OC_2H_4)_2$—$OSO_3$ Na gives good results.

In the treatment of acrylic fibres, that is to say fibres of the polymers and co-polymers of acrylonitrile, it is necessary to exercise very close control over the rate of cooling after treatment at temperatures in the region of 100° C. or higher in order to avoid undesirable harshness of handle resulting from passing through the glass transition temperature (which is generally in the region of 90° to 95° C.) too quickly. In a preferred process the polyacrylonitrile fibres are treated at a liquor to goods ratio of from about 1:1 to 3:1, preferably 1.5:1, the material being tumbled in a drum at room temperature to effect substantially uniform distribution of the treatment liquor through the material. The temperature is then raised to 100° C. and maintained there, for example, for 20 minutes; sufficient boiling water is then introduced to raise the liquor to goods ratio until free liquor is visible outside the textile material which is then allowed to cool to 50° C. under carefully controlled conditions. Preferably the rate of cooling from 95° C. is about ½° C./minute and below 90° C. about 1° C./minute. During this cooling step the liquor to material ratio may be higher than 5:1, for example 7:1. Rotation of the drum is continued throughout this process. If desired the material can then be given an after-treatment with a softening agent at a liquor to goods ratio of from 0.25:1 to 5:1, preferably 1.5:1.

When wool is to be treated by the process of the invention it is desirable to apply a shrink-proofing agent as a preliminary step.

When treatment is completed, it is possible to hydro-extract and, in many forms of our process, to treat the hydro-extract in order to purify the water for recycling. For example the hydro-extract may be treated by the so-called Krupp-CATOX Process, which is a chemical method of supplying the oxygen need of the waste water by catalytic wet oxidation rather than by a biological process that has been developed by Messrs. Fried.Krupp GmbH Industrial Building and Engineering Works, Essen.

Although we normally prefer to use liquor to goods ratios of from 1:1 to 2:1, reduction clearing of dark shades in polyesters is best carried out at higher liquor to goods ratios, e.g. ratios of between 3.5:1 and 4.0:1, such ratios usually providing a small amount of free liquor outside the material.

It is also possible to carry out shade correction. Thus, if the correct shade is not initially obtained in a dyeing process in accordance with our invention the temperature can be reduced and more dye (sufficient to correct the shade) dissolved in a small amount of water also containing any other product conventionally used for restraining strike and compatible with the dye e.g. the adduct of 25 moles of ethylene oxide on 1 mole of 2-stearylaminoethylamine quaternized with 1 mole of dimethylsulphate can then be added, the overall effect being to raise the liquor to goods ratio by 0.5:1 (say). After a further period of tumbling at the lower temperature the material can again be heated to continue the dyeing process.

The process of the present invention is of particular value for dyeing procedures since it allows very level and fast dyeings to be obtained and since the quantity of dyeing assistants and water is minimal when compared with the known dyeing processes in which, in order to obtain dyeings of similar levelness and fastness to those obtainable by the process of the present invention, it is necessary to use much more dyeing liquor, i.e. more water and dyeing assistants. It is also of value since it allows one to use a large range of dyes, especially anionic dyes, of which particularly dyes with low substantivity are profitably employed. Furthermore it is applicable to all conventional textile procedures, particularly those unsuitable for padding processes, and to all forms of textile including garments (with or without seams), yarn and half hose.

In the following Examples percentages are percentages by weight based on the weight of fabric being treated. Liquor to goods ratios are expressed as ratios by weight.

EXAMPLE 1

In this Example 500 gms. of a texturised knitting yarn made of nylon 66 were dyed at a liquor to goods ratio of 1.5:1 with a liquor containing:

- 0.2% sodium 1-(4'-methoxyphenylazo)-4-phenylazonaphthalene-3''-sulphonate.
- 0.06% sodium 1-cyclohexylamino-4-(4'-methoxyphenylamino)-anthraquinone-2'-sulphonate.
- 0.04% sodium 1-(4'βγ-dihydroxypropylamino-phenylazo)-4-phenylazo-naphthalene-6-sulphonate.
- 2.4% lauryl—$(OC_2H_4)_2$—$OSO_3Na$.
- 2.0% adduct obtained by reacting 90 moles of ethylene oxide with 1 mole of 3-stearylaminopropylamine.
- 3.0% Ammonium Dihydrogen Orthophosphate.

The liquor was placed inside a 36" diameter drum whose cylindrical inner surface is provided with a number of inwardly directed baffles and which has an axial length of 12". The yarn, contained in a loose cotton fabric bag, was placed in the drum and the drum was then rotated at 30 revolutions per minute to tumble the yarn, whereby the yarn absorbed all of the liquor. After 15 minutes at 20° C., the temperature was then raised to 96° C., whereby the dye liquor was caused to evaporate and the atmosphere inside the drum became saturated with water vapor, and held there for 20 minutes, whereby the dye was fixed to the yarn while the yarn was moving in the water vapor-saturated atmosphere. The nylon was removed from the drum, rinsed and dried. The resultant fawn dyeing was level and of good fastness.

EXAMPLE 2

500 gms. of a knitted fabric of nylon 6 were introduced into the drum used in Example 1 in which had previously been placed a liquor containing:

- 0.02% 4,4'-bis-(4''-amino-3''-sulpho-anthraquinonyl-1''-amino)-1,1'-diphenylmethane, as its sodium salt.
- 2.4% lauryl-$(OC_2H_4)_2$-$OSO_3Na$.
- 2.0% adduct obtained by reacting 90 moles of ethylene oxide with 1 mole 3-stearylaminopropylamine.

The liquor to material ratio was 1.5:1. The drum was then rotated at 30 revolutions per minute for 15 minutes at 20° C., whereby the goods absorbed all of the liquor. Then the temperature was taken up to 96° C. Heating was continued at this temperature for 20 minutes whereby the dye was fixed to the fabric while the fabric moved in an atmosphere saturated with water vapor, and the nylon was then removed from the drum, rinsed and dried. The resultant pale blue dyeing was level and of good fastness.

EXAMPLE 3

500 gms. of wool worsted piece goods were pretreated with 2.0% formic acid at the boil in a 40:1 liquor for 10 minutes, followed by hydro-extraction.

The hydro-extracted fabric was then dyed in the drum used in Example 1 in a 1.4:1 liquor. The dye liquor contained:

0.16% sodium 1-(2'-phenylaminosulphonyl-phenylazo)-2-amino-8-hydroxy-naphthalene-6-sulphonate.

0.25% sodium 1-(2'-chlorophenyl)-3-methyl-4-(3''-phenyl-aminosulphonyl-phenylazo)-5-pyrazolone-5'-sulphonate.

0.08% sodium 1-amino-4-(4'-acetylamino-phenylamino)anthraquinone-2,5-disulphonate.

2.4% lauryl—$(OC_2H_4)_2$—$OSO_3Na$.

1.2% highly sulphonated castor oil.

10.0% Glauber's Salt.

The drum was set to rotate at 30 r.p.m. and after 15 minutes at 20° C. the temperature of the drum was raised to 95° C., with resultant vaporization of the aqueous dye liquor and saturation of the atmosphere in the drum with water vapor, dyeing was thereafter continued at this temperature for 40 minutes, whereby the dye was fixed to the goods while they were moving in an atmosphere saturated with water vapor. The worsted fabric was then removed from the drum, rinsed and dried to give a fawn dyeing which was level and of good fastness.

EXAMPLE 4

In this Example 500 gms. of cellulose triacetate, in the form of a fabric woven from filament "Tricel" was dyed at a liquor to material ratio of 1.5 to 1 with a dye liquor containing 0.36% 2.6-dichloro-4-nitro-4'-(N-β-cyanethyl-N-β-acetoxy-ethylamino)-1,1'-azo-benzene.

0.15% 1,5-diamino-4,8-dihydroxy-2-(4'-hydroxy-phenyl)anthraquinone.

0.054%2-cyano-4-nitro-4'-(N-β-cyanoethyl-N-β-acetoxyethylamino)-1,1'-azo-benzene.

5.3% diethylphthalate.

2.4% lauryl-$(OC_2H_4)_2$—$OSO_3Na$.

0.56% sodium dinaphthylmethane-disulphonate.

0.3% sodium cethylsulphate.

0.38%sodium sulphate.

"Tricel" is a Registered Trade Mark.

The dye liquor was placed in the drum used in Example 1, the fabric was introduced and the drum was set rotating at 30 r.p.m. After 15 minutes at 20° C. the temperature of the drum was raised to 95° C. and heating was continued for 60 minutes at 95° C. The triacetate fabric was then removed from the drum, rinsed and dried. The resultant fawn dyeing was level and of good fastness.

EXAMPLE 5

In this Example 536 gms. of a knitted fabric of nylon 6 were dyed at a liquor to material ratio of 1.5:1 with a dye liquor containing:

0.2% sodium 1-(4'-methoxyphenylazo)-4-phenylazonaphthalene-3''-sulphonate.

0.06% sodium 1-cyclohexylamino-4-(4'-methoxy-phenylamino)-anthraquinone-2'-sulphonate.

0.04% sodium 1-(4'-ββ-dihydroxypropylamino-phenylazo)-4-phenylazo-naphthalene-6-sulphonate.

2.4% lauryl—$(OC_2H_4)_2$—$OSO_3Na$.

2.0% adduct obtained by reacting 90 moles of ethylene oxide with 1 mole of 3-stearylamino-propylamine.

3.0% Ammonium Dihydrogen Orthophosphate.

This dye liquor was placed in the drum used in Example 1. The fabric was introduced and the drum rotated at 30 r.p.m. for 15 minutes at 20° C. The temperature was then raised to 96° C. and held there for 20 minutes. The nylon was removed from the drum, rinsed and dried. The fabric was dyed to a level fawn shade and the dyeing was of good fastness.

EXAMPLE 6

500 gms of knitted halfhose of nylon 6 were treated at a liquor/material ratio of 1.5:1 with a liquor containing:

0.1% sodium, 4,4'-bis-(6''-methoxy-4''-para-methyl-phenoxy-1'', 3'', 5''-triazinyl-2''-amino)-stilbene-2,2'-disulphonate.

2.4% lauryl—$(OC_2H_4)_2$—$OSO_3Na$.

2.0% adduct obtained by reacting 90 moles of ethylene oxide with 1 mole of 3-stearylamino-propylamine.

1% Acetic Acid.

This liquor was placed in the drum used in Example 1. The fabric was introduced and the drum rotated at 30 r.p.m. for 15 minutes at 20° C. The temperature was then raised to 80° C. and held there for 20 minutes. The nylon was removed from the drum, rinsed and dried. A good level white was obtained.

In Examples 4–6, as in Examples 1–3, the liquor good ratio was such that the liquor was substantially completely absorbed by the material during the application and distribution stages. Also, the amount of aqueous dye liquor present, at least about 700 grams in each Example, was more than adequate to effect saturation of the approximately 7 cubic foot volume of the drum at the temperatures and times employed in the fixing steps.

EXAMPLE 7

The machine used in this and the succeeding Examples 8 to 20 consists of a perforated drum with baffles on its cylindrical inside surface to lift the material being treated as the drum rotates. This drum is enclosed in an outer casing with only a small clearance between the casing and the drum. The diameter of the drum is approximately 36" and its axial length 12". The perforated drum can be rotated at two speeds, slow for liquor circulation and distribution and fast to act as a hydro-extractor. The atmosphere in the equipment can be heated by injection of hot air or steam. The drum can also be heated or cooled as desired by external circulation of water around the casing. Treatment liquors and other liquids can be sprayed into the machine by means of compressed air through a jet and an opening in the front of the machine.

1672 g. of dry woollen garments were treated in the above-described machine at a liquor to goods ratio of 2:1 with a bath liquor containing:

0.1% a mixture of the 2:1 chromium complex compounds of 1-(2'-hydroxyphenylazo)-2-phenylaminonaphthalene-5'-sulphonic acid amide, 1-(2'-hydroxyphenylazo)-2-hydroxy-8-acetyl-aminonaphthalene-5'-sulphonic acid amide, 1-(2'-hydroxyphenylazo)-2-hydroxynaphthalene-5'-sulphonic acid-β-hydroxyethylamide and, 1-(4'-chlorophenyl)-3-methyl-4-(2''-carboxy-phenylazo)-5-pyrazolone-4''-sulphonic acid-methylamide in the ratio of 60:20:17:3, 2.4% Lauryl-$(OC_2H_4)_2$—O—$SO_3$ Na,
2% Acetic acid.

The dry garments were placed in the drum and the liquor added. The drum was rotated at its slow speed (i.e. about 30 r.p.m.) for 15 minutes. The temperature was raised to 100° C. and the drum then cooled to room temperature again. After cooling the speed of the drum was increased to its faster speed in order to hydro-extract for a few minutes. This reduced the aqueous content of the garments to about 50%. Sufficient acetic acid solution (10 g $CH_3COOH$/liter) was added to produce a liquor to goods ratio of about 2:1 and the drum again rotated at a slow speed for several minutes in order to effect rinsing followed again by hydro-extraction. Finally the garments were dried in the machine by circulating hot air through it. The resultant grey dyeing was level, including inside the seams and folds of the dyed garments.

EXAMPLE 8

3 Kg. of Dylan XB treated woollen garments (i.e. wool that had been treated with a shrink-proofing agent) were dyed in the machine described in Example 7 at a liquor to goods ratio of 2:1 with a liquor containing:

0.2% 2:1 chromium complex compound of 1-phenyl-3-methyl-4-(2'-carboxyphenylazo)-5-pyrazolone-4'-sulphonic acid-methylamide,
0.025% 2:1 chromium complex compound of 1-(4'-cyanophenyl)-3-methyl-4-(2''-hydroxyphenylazo)-5-pyrazolone-4''-sulphonic acid amide,
0.009% 2:1 chromium complex compound of 1-(2'-hydroxy-5'-methylsulphonylphenylazo)-2-hydroxy-8-acetylaminonaphthalene,
3% monoammonium phosphate,
2.4% Lauryl—$(OC_2H_4)_2$—O—$SO_3$Na.

The dry garments were placed in the drum and the liquor added. After 15 minutes rotation of the drum at room temperature heat was applied to raise the drum to 100° C. After 15 minutes at 100° C. the temperature was lowered to 50° C., the garments were hydro-extracted, rinsed and dried. The garments were dyed an orange-brown colour and good exhaustion, penetration of seams and overall levelness was observed.

EXAMPLE 9

3 Kg. of nylon 6 garments were dyed at a liquor to goods ratio of 1.5:1. The liquor contained:

0.08% sodium 1-phenylazo-4-(4'-β,γ-dihydroxypropylaminophenylazo)-naphthalene-6-sulphonate.
0.8% sodium 1-phenylazo-4-(2'-methoxy-5'-methylphenylazo)naphthalene-6-sulphonate,
1.04% sodium 1-phenylamino-4-(4'-phenylazo-naphthyl-1'-azo)-naphthalene-8,3''-disulphonate,
2.80% 2:1-chromium complex compound of sodium 1-(2'-hydroxynaphthyl-1'-azo)-2-hydroxy-6-nitronaphthalene-4-sulphonate.

The dry garments were then placed in the drum, the liquor was added and the drum rotated for 15 minutes at room temperature. After heating to 100° C. rotation of the drum was continued for 15 minutes followed by cooling to 70° C. The garments were hydro-extracted for 2 minutes to reduce the liquor to goods ratio to about 0.5:1. Sufficient water was then added to raise the liquor to goods ratio to about 1:1 (i.e. about 1.5 liters) and the drum was again rotated to rinse the garments. After hydro-extraction, the garments were then treated in the drum for back-tanning at a liquor to goods ratio of about 1.5:1 with a liquor containing:

0.6% Product obtained by condensing together naphthalenesulphonic acid, formaldehyde and bis-(hydroxyphenyl)sulphone
1% Formic acid
0.6% Lauryl—O—$(C_2H_4)_2$—$OSO_3$ Na (in other words the calculated quantities of the backtanning agent, formic acid and foaming agent were dissolved in 3 liters of water which was then added to bring the ratio back to about 1.5:1, the garments after the preceding hydro-extraction containing approximately 50% of their weight of liquid). The temperature was again raised to 70° C. and the drum rotated for 10 minutes, followed by hydro-extraction. Sufficient water was then added to bring the liquor to goods material back to about 1.5:1 (i.e. about 3 liters of water were added) and the garments again hydro-extracted and dried with hot air in the drum. A good level fast black dyeing was obtained.

The dyes used in Examples 7 to 9 may be replaced by any of the following dyes, or mixtures of any two or more thereof:

A Sodium 1-phenyl-3-methyl-4-(4''-methyl-1-3''-phenylaminosulphonyl-phenylazo)-5-pyrazolone-4'-sulphonate (yellow),
B Sodium 1-(2'-chloro-5'-methylphenyl)-3-methyl-4-[4''-(4'''-chloro-6'''-phenylamino-1''',3''',5'''-triazinyl-2'''-amino)-phenylazo]-5-pyrazolone-4',4''''-disulphonate (yellow),
C Sodium 1-hydroxy-2-phenylazo-6-benzoylamino-naphthalene-3,2'-disulphonate (orange),
D Sodium 2-nitro-4'-[4''-(4'''-phenylsulphonyloxy)-phenylazo]1,1'-diphenylamine-4-sulphonate (orange),
E Sodium 1-(2'-methoxy-5'-methylphenylazo)-4-phenylazonaphthalene-6-sulphonate (orange-brown),
F Sodium 1-(2'-phenylaminosulphonylphenylazo)-2-amino-8-hydroxynaphthalene-6-sulphonate (bluish red),
G Sodium 1-(4'-β,γ-dihydroxypropylamino-phenylazo)-4-phenylazo-naphthalene-6-sulphonate (rubine),
H Sodium 1-amino-4-(4'-benzoylaminophenylamino)-anthraquinone-2-sulphonate (blue),
I Sodium 1-amino-4-(4'-methyl-3'-β-hydroxyethylaminosulphonylphenylamino)-anthraquinone-2-sulphonate (blue),
J Sodium 1-amino-4-(3'-acetylaminophenylamino)-anthraquinone-2-sulphonate (blue),
K Sodium salt of the monosulphonic acid from 1,4-Bis-(4'-methylphenylamino)-anthraquinone (green),
L Sodium salt of 6,7-Dichloro-1,4-bis-(5',6',7',8'-tetrahydro-γ'-sulpho-naphthyl-2'-amino)-anthraquinone (green),
M Sodium 1-hydroxy-2-(4'-methyl-3'-phenylaminosulphonylphenylazo)-naphthalene-4-sulphonate (reddish orange),
N Sodium 4-(1''-hydroxynaphthyl-2''-azo)-4'-(4'''-p-methylphenylsulphonyloxy-phenylazo)-2,2'-dimethyl-1,1'-diphenyl-3'',6''-disulphonate (yellowish red),
O Sodium 4-(2''-hydroxynaphthyl-1''-azo)-4'-(4'''-p-methylphenylsulphonyloxy-phenylazo)-3,3'-dimethyl-1,1'-diphenyl-6'',8''-disulphonate (red), P Sodium 4-(2''-amino-8''-hydroxynaphthyl-1''-azo)-4'-(4'''-octyloxycarbonylaminophenylazo)-2,2'-dimethyl-1,1'-diphenyl-5,6''-disulphonate (bluish red), Q Sodium 1-benzoyl-2-hydroxy-4-(4'-tert-butylphenoxy)-6-(4''-methylphenylamino)-3-azobenzanthrone)-2',2''-disulphonate (bluish red), R Sodium 1-amino-2-(4'-tert-amylphenoxy)-4-(2'',4'',6''-trimethylphenylamino)-anthraquinone-2',3''-disulphonate (bluish violet), S Disodium salt of 4,4'-bis-(4''-amino-3''-sulphoanthraquinonyl-1''-amino)-1,1'-diphenylmethane (blue), T Disodium salt of disulphonated bis-1,4-[4'-(4''-chlorophenoxy)-phenylamino]-anthraquinone (bluish green), U Sodium 1-amino-4-cyclohexylaminoanthraquinone-2-sulphonate (reddish blue), V Sodium 1-amino-4-phenylaminoanthraquinone-2-sulphonate (blue), W Sodium 1-amino-4-(2',4',6'-trimethylphenylamino)-anthraquinone-2-sulphonate (reddish blue), X Sodium 1-amino-4-(2',4',6'-trimethyl-3'-α-chloroacryloyl-aminomethylphenylamino)-anthraquinone-2-sulphonate (reddish blue), Y Sodium salt of copper phthalocyanine-trisulphonic acid (turquoise blue), Z Sodium 1-phenylamino-4-(4'-phenylazo-naphthyl-1'-azo)naphthalene-8,3''-disulphonate (navy blue), AA Sodium salt of copper phthalocyanine-disulphonamidesulphonic acid (turquoise blue), BB 1-(2',5'-Dichlorophenyl)-3-methyl-4-(naphthyl-2''-azo)-5-pyrazolone-4',1''-disulphonic acid (yellow), CC 1-(4'-Acetylaminophenylazo)-2-amino-8-hydroxynaphthalene-6,2'-disulphonic acid (bluish red), DD 1-(4'-Phenylamino-naphthyl-1'-azo)-8-hydroxynaphthalene-3,6,5'-trisulphonic acid (reddish blue), EE 4,4'-Bis-(4''-ethoxyphenylazo)-1,1'-diphenyl-2,2'-disulphonic acid (yellow), FF 4-(2''-Hydroxynaphthyl-1''-azo)-4'-(4'''-phenylsulphonyloxyphenylazo)-2,2'-dimethyl-1,1'-diphenyl-6'',8''-disulphonic acid (reddish orange), GG 1-Phenylamino-4-(4'-phenylazonaphthyl-1'-azo)-naphthalene-8,3''-disulphonic acid (reddish blue), HH 1-Amino-4-phenylaminoanthraquinone-2-sulphonic acid (blue), II 1,4-Bis(4'-methyl-2'-sulphophenylamino)-anthraquinone (bluish green), JJ 1-Benzoyl-2-hydroxy-4-(4'-cyclohexylphenoxy)-6-(4''-methylphenylamino-3-azobenzanthron-2',2''-disulphonic acid (bluish red), KK Copper phthalocyanine disulphonic acid (turquoise blue), LL 1-(2',4'-Dinitrophenylamino)-4-phenylaminobenzene-3-sulphonic acid (yellowish brown), MM The dyestuff of formula

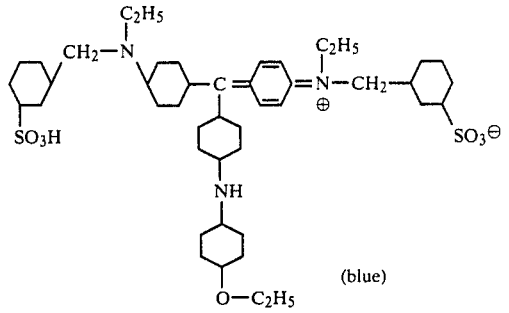

(blue)

NN The dyestuff of formula

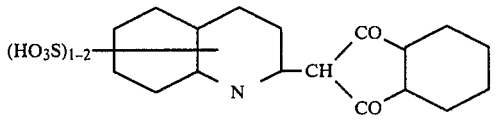

(greenish yellow),

OO The dyestuff of formula

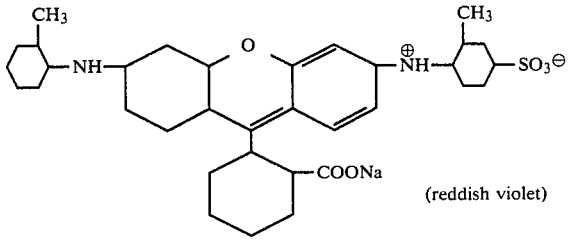

(reddish violet)

PP 1:1-Chromium complex compound of 1-Phenyl-3-methyl-4-(2''-hydroxy-5''-chlorophenylazo)-5-pyrazolone-3',3''-disulphonic acid (yellowish red), QQ 1:2-Chromium complex compound of 1-Phenyl-3-methyl-4-(2''-hydroxy-3''-nitro-5''-chlorophenylazo)-5-pyrazolone-3'-sulphonic acid methylamide (bluish red), RR 1:2-Cobalt complex compound of 1-Hydroxy-2-(2'-hydroxy-3'-acetylamino-5'-methylphenylazo)-4-nitrobenzene (reddish brown)

SS 1-Phenyl-3-methyl-4-(2'-hydroxy-5'-methylphenylazo)-5-pyrazolone-3'-sulphonic acid (yellowish red), TT 1-Amino-4-(2',4',6'-trimethyl-3',5'-dibromophenylamino)-anthraquinone-2-sulphonic acid (reddish blue), UU 1-Amino-4-(4'-acetylaminophenylamino)-anthraquinone-2'-sulphonic acid (greenish blue), VV The 1:2-chromium complex compound of 1-(4'-chlorophenyl)-3-methyl-4-(2''-hydroxy-5''-methylaminosulphonylphenylazo)-5-pyrazolone (orange), WW The 1:2-chromium complex compound of 1-[2'-hydroxy-5'-(2''-hydroxyethylaminosulphonyl)-phenylazo]-2-hydroxynaphthalene (violet), XX The 1:2-cobalt complex compound of 1-[2'-hydroxy-5'-(2''-hydroxy-ethylaminosulphonyl)-phenylazo]-2-hydroxynaphthalene (bordeaux);

YY The 1:2-Chromium complex compound of 1-phenyl-3-methyl-4-(2''-hydroxy-3''-nitro-5''-methylphenylazo)-5-pyrazolone-4'-sulphonic acid β-hydroxyethylamide (bluish red), ZZ The 1:2-mixed chromium complex compound of 1-(2'-hydroxynaphthyl-1'-azo)-2-hydroxy-6-nitronaphthalene-4-sulphonic acid and 1-(2'-hydroxy-naphthyl-1'-azo)-2-hydroxy-4-nitrobenzene (black), AZ The 1:2-chromium complex compound of 1-(2'-hydroxy-5'-methylsulphonylphenylazo)-2-hydroxy-8-methoxycarbonylamino-naphthalene (bluish grey), BZ The 1:2-chromium complex compound of 1-hydroxy-2-(2'-hydroxy-3'-acetylamino-5'-methylphenylazo)-4-nitrobenzene (brown), CZ The 1:2-chromium complex compound of 1-(4'-chlorophenyl)-3-methyl-4-(2''-carboxyphenylazo)-5-pyrazolone-4''-sulphonic acid ethylamide (yellow), DZ The 1:2-chromium complex compound of 1-(2'-hydroxyphenylazo)-2-phenylaminonaphthalene-5'-sulphon-amide (grey), EZ The 1:2-cobalt complex compound of 1-(2'-hydroxy-5'-chlorophenylazo)-2-aminonaphthalene-6-sulphonic acid (β-hydroxy)-ethylamide (navy blue), FZ The 1:2-mixed cobalt complex compound of 1-(2'-hydroxy-4'-nitrophenylazo)-2-aminonaphthalene-6-sulphonic acid-(β-hydroxy)-ethylamide and 1-(2'-hydroxy-4'-nitrophenylazo)-2-hydroxynaphthalene (blue).

EXAMPLE 10

3 Kg. of polyester garments (made from "Terylene" which had been set at 135° C.) were placed in dry condition in the drum of the machine used in Examples 7 to 9 and treated at a liquor to goods ratio of 1.5:1. The liquor contained:

0.087% 4-[4'-(4''-hydroxyphenylazo)-phenylazo]-benzene 0.0036% 1-(4'-N-β-cyanoethyl-N-ethylamino-phenylazo)-2-chloro-4-nitrobenzene 0.0084% 1-amino-2-phenoxy-4-hydroxyanthraquinone 0.006% brominated 1,5-diamino-4,8-dihydroxyanthraquinone 0.105% Sodium dinaphthylmethanedisulphonate 0.070% Sodium cetylsulphate 0.070% Sodium sulphate 1.800% Lauryl-$(OC_2H_4)_2$—O—$SO_3Na$ 7.500% Benzyl alcohol This liquer was added to the garments in the drum and the drum rotated for 15 minutes at room temperature. The temperature was raised to 100° C. and maintained at this temperature for 20 minutes.

After cooling to 80° C. the garments were hydro-extracted for 3 minutes to reduce the water content of the garments to 25 to 30%. The garments were then rinsed twice in the drum at a liquor to goods ratio of 1:1, with hydro-extraction between rinses after a further hydro-extraction the garments were dried in hot air in the drum upon which level of mustard shade was obtained.

"Terylene" is a Registered Trade Mark.

EXAMPLE 11

3 Kg. of garments made from Courtelle (i.e. an acrylic fibre) were dyed in the machine described in Example 7 at a liquor to goods ratio of 2:1. The liquor contained:

0.02% of the dye of formula

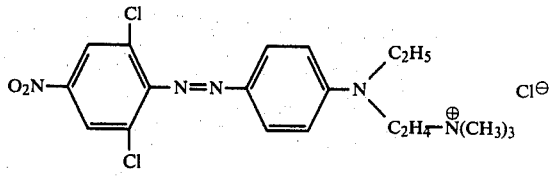

0.0012% of the dye of formula

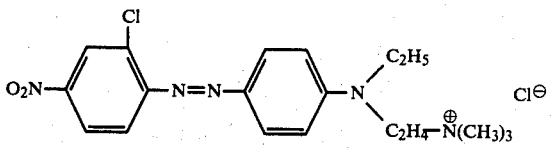

0.025% of the dye of formula

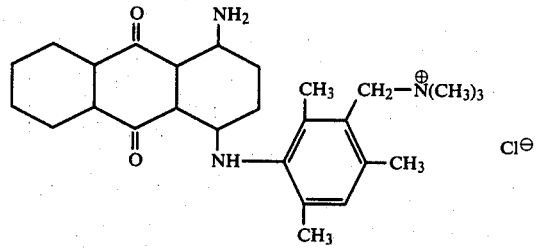

0.4% dextrin

6% nonylphenylpentadecaglycol ether.

This liquor was adjusted with acetic acid to give a pH of 5.5 before it was brought into contact with the garments to be dyed. After addition of the dye liquor the drum was rotated for 15 minutes at room temperature and the temperature was then raised to 100° C. where it was held for 20 minutes. Boiling water was added at the bottom of the machine to show the clear presence of liquor inside the drum. After cooling to 50° C. at a rate of 2° C./min, the garments were hydro-extracted and rinsed with water. The garments were then given an after treatment for 10 minutes to soften them, again at a liquor to goods ratio of about 2:1, with 0.15% of the condensation product of 1 mole of diethylene triamine with 1.5 moles of stearic acid and 0.55 moles of acetic anhydride. The after-treatment liquor had a pH of 5. The garments were hydro-extracted again and dried with hot air in the machine. The garments were thus dyed a level silver grey shade, had excellent handle and were substantially free from creases.

EXAMPLE 12

In this Example 3 kg. of garments made from Viscose fibres were dyed in the machine described in Example 7 at a liquor to goods ratio of 1.5:1 with a dye liquor containing:

0.5% Sodium 2-[4'-(2''-methyl-4''-trichloropyrimidylaminophenylazo)-2'-methylphenylazo]-naphthalene-4,6,8-trisulphonate 0.25% 1:1 copper complex compound of sodium 1-hydroxy2-(2'-hydroxyphenylazo)-6-trichloropyrimidylaminonaphthalene-3,3', 5'-tri-sulphonate 0.85% 1:1 copper complex compound of the dye of formula

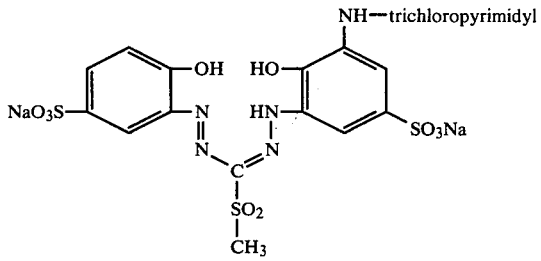

7.50% Urea
1.80% Soda ash
1.50% Glauber's salt
1.20% Sodium 3-nitrobenzenesulphonate
1.80% Lauryl—$(OC_2H_4)_2$—O—$SO_3Na$ The dry garments were placed in the drum and the liquor introduced. The drum was rotated for 15 minutes at room temperature. The temperature was then raised to 100° C. and held there for 15 minutes. After hydro- ZK Sodium 1-amino-4-4'-[N-(2'',3''-dichloroquinoxalyl-6''-carbonyl)-N-methyl-amino-methyl]-phenylamino)anthraquinone-2,3'-disulphonate (blue), ZL Di-sodium salt of copper phthalocyanine-(3)-disulphonic acid-sulphonic acid amide-sulphonic acid[3'-(4''-amino-6''-chloro-1'',3'',5''-triazinyl-2''-amino)6'-sulphophenylamide] (turquoise blue), ZN Di-sodium salt of copper phthalocyanine-(3)-disulphonic acid-sulphonic acid amide-sulphonic acid (3'-trichloropyrimidylaminophenylamide) (turquoise blue), ZN Sodium 4-trichloropyrimidylamino-4'-[3''-methyl-4''-(2'''-methylphenylazo)-5''-pyrazolonyl-1''-azo]-stilbene-2,2',5''-trisulphonate (yellow), ZO Bis-copper complex compound of sodium 1,6-dihydroxy-2-(2'-hydroxy-5'-trichloropyrimidylaminophenylazo)-5-(1''-hydroxynaphthyl-2''-azo)-naphthalene-3,3',4'',6''-tetrasulphonate (dark blue),

ZP

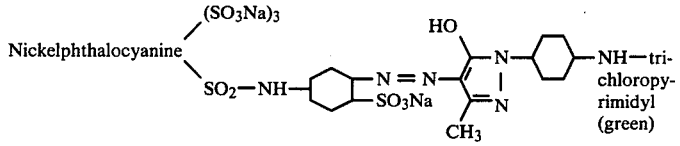

(3)

extraction and rinsing twice the garments were dried with hot air in the machine. The resultant brown dyeing was level and of good fastness.

The mixture of dyes used in this Example can be replaced by any of the following listed dyes or by a mixture of any two or more thereof:

ZA Sodium 1-hydroxy-2-phenylazo-8-[2''-amino-4''-(4'''-trichloropyrimidylaminophenylamino)-1'',3'',5''-triazin-6''-ylamino]-naphthalene-2',3,6-trisulphonate (red), ZB Potassium 1-(2'-chloro-6'-methylphenyl)-3-methyl-4-(2''-methoxy-5''-sulphato-ethylsulphonyl-phenylazo)-5-pyrazolone-4'-sulphonate (yellow), ZC Copper complex of potassium-hydroxy-2-(2'-hydroxy-4'-vinylsulphonylphenylazo)-8-acetylaminonaphthalene-3,6-disulphonate (violet), ZD Potassium 1-hydroxy-8-amino-2,7-bis(4'-sulphatoethylsulphonylphenylazo)-naphthalene-3,6-disulphonate (black), ZE The 1:2 mixed chromium/cobalt complex of sodium 1-hydroxy-2-(2'-hydroxy-6'-nitronaphthyl-1'-azo)-6-(4''-chloro-6''-amino-1'',3'',5''-triazinyl-2''-amino)naphthalene-3,4'-disulphonate (black), ZF Sodium 1-(2',5'-dichlorophenyl)-3-methyl-4-[3''-(4''',6'''-dichloro-1''',3''',5'''-triazinyl-2'''-amino)-phenylazo]-5-pyrazolone-4',6''-disulphonate (yellow), ZG Sodium 1-hydroxy-2-phenylazo-6-(4'',6''-dichloro-1'',3'',5''-triazinyl-2''-amino)-naphthalene-3,2'-disulphonate (orange), ZH Sodium 2-[4'-(2'',3''-dichloroquinoxalyl-6''-carbonylamino)-2'-methyl-phenylazo]-naphthalene-4,8-disulphonate (reddish yellow), ZI Sodium 1-amino-4-[3'-(4'',6''-dichloro-1'',3'',5''-triazinyl-2''-amino)-phenylamino]-anthraquinone-2,4'-disulphonate (blue), ZJ Sodium 1-amino-4-(3'-trichloropyrimidylamino-phenylamino)-anthraquinone-2,4'-disulphonate (blue),

EXAMPLE 13

3 Kg. of nylon 66 garments were treated with a liquor containing a brightening agent in the apparatus of Example 7 at a liquor to goods ratio of 1.5:1. The liquor contained:

0.2% sodium 4,4'-bis-(6''-methoxy-4''-para-methyl-phenoxy-1'',3'',5''-triazinyl-2''-amino)-stilbene-2,2'-disulphonate
1,8% Lauryl—$(OC_2H_4)_2$—$OSO_3$ Na
2% Formic acid The dry garments were placed in the drum and the liquor introduced. After 15 minutes rotation at room temperature the temperature was raised to 100° C. where it was held for 15 minutes. After cooling to 70° C. the garments were hydroextracted, rinsed twice and dried with hot air in the machine. A good level white was obtained.

EXAMPLE 14

3 Kg. of Tricel piece goods were treated with a liquor containing an "S" finishing agent in the apparatus of Example 7 at a liquor to goods ratio of 1.5:1. The liquor contained:

1.8% Lauryl—$(OC_2H_4)_2$—O—$SO_3$ Na
3% Caustic soda

The dry piece goods were placed in the drum and the liquor introduced. After 15 minutes rotation at the slow speed at room temperature the temperature was raised to 70° C. where it was held for 20 minutes. A further 0.5:1 volume of liquor was added at 70° C., this liquor containing:

0.3% 2-cyano-4-nitro-4', -(N-β-cyanoethyl-N-β-acetoxyethylamino)-1,1'-azobenzene
0.2% Sodium cetylsulphate
0.2% Sodium sulphate
0.3% Sodium dinaphthylmethane-disulphonate
0.6% Lauryl—$(OC_2H_4)_2$—O—$SO_3$ Na
5% Acetic acid.

Rotation of the drum was continued while the temperature was raised to 100° C. After 1 hour at 100° C. the piece goods were hydro-extracted, rinsed twice in the drum at a liquor to goods ratio of 1:1, with hydro-extraction between rinses. After a further hydro-extraction the piece goods were tumbled dried in hot air in the drum upon which a level red shade of good fastness was obtained.

"Tricel" is a Registered Trade Mark.

EXAMPLE 15

In this Example 1842 gms of "Tricel" piece goods were dyed in the machine described in Example 7. A liquor to goods ratio of 1.5:1 was used. The dye liquor contained:

0.165% 2,6-dichloro-4-nitro-4'-(N-β-cyanoethyl-N-β-acetoxyethylamino)-1,1'-azobenzene
0.24% 2-chloro-4-nitro-4'-)N-β-cyanoethyl-N-β-acetoxyethylamino)-1,1'-azobenzene
0.195% 1,5-diamino-4,8-dihydroxy-2-(4-hydroxyphenyl)anthraquinone
0.6% Sodium dinaphthylmethane-disulphonate
0.4% Sodium cetylsulphate
1.8% Lauryl-$(OC_2H_4)_2$—O—$SO_3$ Na
7.6% Benzyl alcohol The piece goods were rotated at room temperature for 15 minutes after the liquor had been added. The temperature was then raised to 100° C. and dyeing continued at that temperature for 1 hour. After hydro-extraction and two rinses at a liquor to goods ratio of 1:1 followed by a final hydro-extraction, the goods were tumble dried in the machine for 20 minutes. The resultant fawn dyeing was both level and fast.

EXAMPLE 16

3 Kg. of socks made from a blend of wool and nylon were dyed at a liquor to goods ratio of 1.5:1 in the machine described in Example 7 with a liquor containing:

0.05% Sodium 2-nitro-4'-(4''-phenylsulphonyloxyphenylazo)-1,1'-diphenylamine-4-sulphonate
0.016% Sodium 1-(4'-methoxyphenylazo)-4-phenylazo-naphthalene-3''-sulphonate
0.144% Sodium 1-cyclohexylamino-4-(4'-methoxyphenylamino)-anthraquinone-2'-sulphonate
1.0% Ammonium dihydrogen orthophosphate
4.5% Sodium lauryl-$(OC_2H_4)_2$-$OSO_3$ Na.

After tumbling the socks with the liquor in the drum for 15 minutes at 30 r.p.m. at room temperature the temperature was raised to 100° C. and held there for 15 minutes. On cooling and after hydro-extraction and rinsing the socks were dyed a level green shade of good fastness.

EXAMPLE 17

The procedure of Example 16 was repeated with a liquor containing:

0.225% Di-sodium salt of 6,7-dichloro-1,4-bis-(2',6'-dimethyl-3'-sulphophenylamino)-anthraquinone
0.2% Sodium 1-amino-4-(4'-benzoylamino-phenylamino)anthraquinone-2-sulphonate
1.0% Ammonium dihydrogen orthophosphate
4.5% Sodium lauryl —$(OC_2H_4)_2$—O—$SO_3$ Na The socks were dyed a level blue shade of good fastness.

EXAMPLE 18

In this Example 3 kg. of socks made from an "Orlon"/nylon blend were dyed in the machine of Example 7 at a liquor to goods ratio of 3.5:1, the pH of the liquor being 5.5. The liquor contained:

0.032% Sodium 1-(4'-methoxyphenylazo)-4-phenylazonaphthalene-3''-sulphonate
0.004% Sodium 1-(4''-βγ-dihydroxypropylamino-phenylazo)-4-phenylazo-naphthalene-6-sulphonate
0.048% Sodium 1-cyclohexylamino-4-(4'-methoxyphenylazo)-anthraquinone-2'-sulphonate
0.096% of the dye of formula:

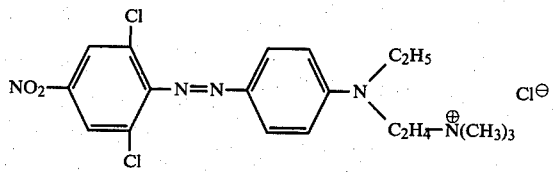

0.024% of the dye of formula

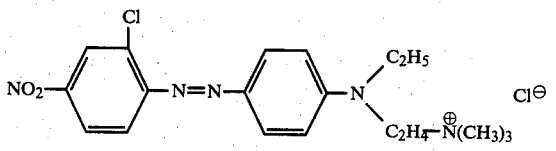

0.12% of the dye of formula

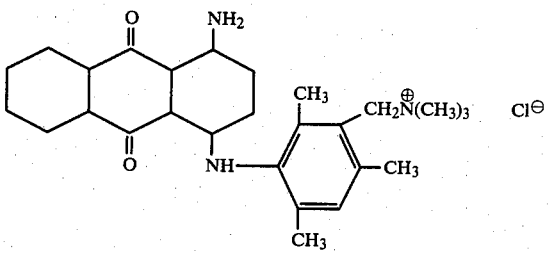

0.66% dextrin
10.5% nonylphenylpentadecaglycol ether.

The drum was rotated at 30 r.p.m. at room temperature for 15 minutes. The temperature was then raised to 100° C. and held there for 20 minutes. Boiling water was then added to show the clear presence of liquid inside the drum. The drum was then allowed to cool to 50° C. at 2° C./minute whilst continuing to rotate the drum and the socks were then hydro-extracted and rinsed with water. They were dyed a level fawn shade of good fastness.

EXAMPLE 19

The procedure of Example 18 was repeated, except that dyeing was continued for 30 minutes at 100° C. and that the liquor contained:

0.275% Sodium 1-(2'-chlorophenyl)-3-methyl-4-[4''-(4'''-chloro-6'''-phenylamino-1''',3''',5'''-triazinyl-2'''-amino)-phenylazo]-5-pyrazolone-5',2''-disulphonate
0.075% Sodium 2-nitro-4'-(4''-phenylsulphonyloxyphenylazo)-1,1'-diphenylamine-4-sulphonate
0.27% Sodium 1-cyclohexylamino-4-(4'-methoxyphenylamino)-anthraquinone-2'-sulphonate
0.44% of the dye of formula

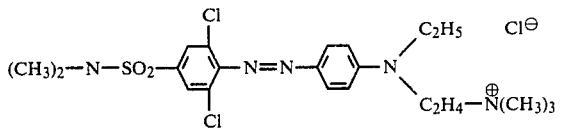

0.042% of the dye of formula

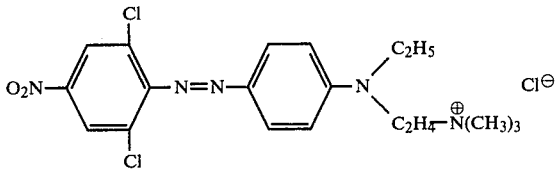

0.09% of the dye of formula

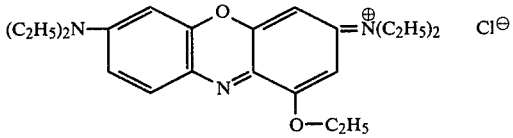

0.063% dextrin 10.5% nonylphenylpentadecaglycol ether.

The socks were dyed a level green shade of good fastness.

EXAMPLE 20

3 Kg. of a fabric made from a cotton/nylon mixture was dyed in the machine of Example 7. The goods to liquor ratio was 2.5:1 and the liquod contained:

0.08% Sodium 1-hydroxy-2-phenylazo-8-{4''-methylamino-6''-[3'''-(2'''',5'''',6''''-trichloropyrimidyl-4''''-amino)-phenylamino]-1'',3'',5''-triazinylamino}-naphthalene-3,6,2'-trisulphonate 0.015% Sodium 1-[4'-(4''-cyclohexylphenoxy)-phenylazo]-2-(2'',4'',6''-trimethylphenylamino)-8-hydroxynaphthalene-6,2'-disulphonate 1.75% Soda ash 7.5% Nonylphenylpentadecaglycol ether 0.2% Sodium-3-nitrobenzenesulphonate After 15 minutes rotation at 30 r.p.m. at room temperature the drum was heated to 100° C. while rotation of it continued. After 30 minutes at 100° C. the fabric was rinsed and hydro-extracted in the drum. The resultant pink dyeing was level and of good fastness.

EXAMPLES 21-26

In each of these Examples 400 grams chromium-tanned cow hide of 1.2 to 1.3 mm thickness are placed in a drum at the end of the tanning operation. A solution of 2.25 grams of the anionic dye of the formula

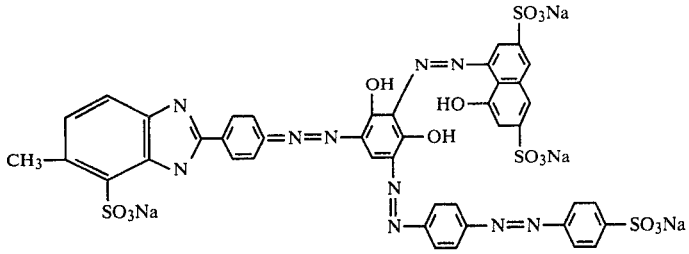

in 200 ml water (20°-25° C.) is prepared with the aid of 3 gms of the foaming agent specified in Table II. After a drumming operation of several minutes, this solution is introduced into the drum and the drum rotated for about 15 to 30 minutes. Thereafter the leather is fat liquored by means of a commercially available fatting agent such as a sulfonated cod liver oil. (The fatting agent optionally is also emulsified in 100 ml water before use).

Fixation is carried out with formic acid under the fixation temperatures conditions specified in Table II. The leathers dyed in accordance with Examples 21 to 26 show good light and colour fastness, and are level and have similar properties to leathers dyed with the same dye by conventional methods. Similar results are obtained when a glove or garment or upholestry leather is used.

EXAMPLES 27-32

In each of these Examples 300 gms. of a damp-dry chromium tanned velour leather are put in a drum. A solution is prepared by dissolving 2.7 gms. of the anionic dyestuff used in Examples 21-26 in 600 ml water at 20°-25° C. with the addition of 9 gms. of a foaming agent. This solution is added to the drum and the leather is tumbled in the drum for 15 to 20 minutes. Thereafter 3 gms. of formic acid are added and fixation carried out under the conditions specified in Table II. A deep, stable and level dyeing is then obtained by adding a solution of 8.1 gms of the afore-mentioned dye in 360 ml water at 20°-25° C. and further rotation of the drum for 30 minutes, followed by a second fixation at the temperature specified in Table II.

The leathers dyed in accordance with Examples 27 to 32 are light- and colour-fast and have the same properties as leathers dyed with the same dye by conventional methods.

Similar results are obtained when a garment velour leather is used.

TABLE II

| Example No. | 21 | 22 | 23 | 24 | 25 | 26 | 27 | 28 | 29 | 50 | 31 | 32 |
|---|---|---|---|---|---|---|---|---|---|---|---|---|
| A | + | + | − | − | − | − | + | + | − | − | − | − |
| B | − | − | + | + | − | − | − | − | + | + | − | − |
| C | − | − | − | − | + | + | − | − | − | − | + | + |
| Starting Temp. | 20-25° C. | 20-25° C. | 20-25° C. | 20-25° C. | 20-25° C. | 20-25° C. | 20-25° C. | 20-25° C. | 20-25° C. | 20-25° C. | 20-25° C. | 20- |
| Distribution | 20- | 20- | 20- | 20- | 20- | 20- | 20- | 20- | 20- | 20- | 20- | 20- |

TABLE II-continued

| Example No. | 21 | 22 | 23 | 24 | 25 | 26 | 27 | 28 | 29 | 50 | 31 | 32 |
|---|---|---|---|---|---|---|---|---|---|---|---|---|
| Temp. | 25° C. | 25° C. | 25° C. | 25° C. | 25° C. | 25° C. | 25° C. | 25° C. | 25° C. | 25° C. | 25° C. | 25° C. |
| Fixation Temp. | 20–25° C. | 60° C. | 20–25° C. | 60° C. | 20–25° C. | 60° C. | 20–25° C. | 60° C. | 20–25° C. | 60° C. | 20–25° C. | 60° C. |

A = Sodium lauryl —$(OC_2H_4)$—$OSO_3$ Na (as 60% paste)
B = 70% solution of partially carboxymethylated alkyl polyglycol ether, i.e. $C_{12}H_{25}$—$(OC_2H_4)_6$—O—$CH_2$—COONa + $C_{12}H_{25}$—$(OC_2H_4)_6$—OH
C = nonylphenylpentadecaglycol ether.

What is claimed is:

1. A low liquor ratio textile finishing process of the kind which comprises a step in which the textile is impregnated with a finishing liquor comprising finishing agent and water and a heating step in which the temperature of the textile is raised to a predetermined finishing temperature, the quantity of finishing liquor being such that the textile absorbs substantially all of the available liquor during the impregnation step, wherein the heating step comprises heating the impregnated textile to the predetermined finishing temperature while moving it in an atmosphere which is substantially or completely saturated with water vapor.

2. A low liquor ratio finishing process in accordance with claim 1, wherein the impregnated textile is moved by a tumbling action and the said atmosphere is circulated around and through the textile as it is tumbled.

3. A low liquor ratio finishing process in accordance with claim 1, wherein steam is injected into said atmosphere so as to saturate it to the desired extent.

4. A low liquor finishing process in accordance with claim 1, wherein the finishing liquor contains formic acid and the temperature is raised to 100° C.

5. A process as claimed in claim 1 wherein the finishing liquor also contains a forming agent.

6. A process as claimed in claim 2 wherein the finishing liquor also contains a foaming agent.

7. A process according to claim 5 wherein the foaming agent is present in the liquor in an amount of from 0.1 to 35 grams per liter.

8. A process according to claim 6 wherein the foaming agent is present in the liquor in an amount of from 0.1 to 35 grams per liter.

9. A process according to claim 1 wherein the liquor to goods ratio is from 0.25:1 to 5:1.

10. A process according to claim 8 wherein the liquor to goods ratio is from 0.25:1 to 5:1.

11. A process according to claim 1 wherein the finishing liquor is a dyeing liquor.

12. A process according to claim 10 wherein the finishing liquor is a dyeing liquor.

13. A process according to claim 5 which further comprises subjecting the liquor-impregnated textile to a mechanical treatment whereby a foam is developed and dispersed uniformly throughout the textile material.

* * * * *